US007481548B2

(12) United States Patent
Tokushita

(10) Patent No.: US 7,481,548 B2
(45) Date of Patent: Jan. 27, 2009

(54) PORTABLE CASE

(75) Inventor: Takayuki Tokushita, Tokyo (JP)

(73) Assignee: Yoshida Industry Co., Ltd., Tokyo (JP)

( * ) Notice: Subject to any disclaimer, the term of this patent is extended or adjusted under 35 U.S.C. 154(b) by 0 days.

(21) Appl. No.: 10/579,757

(22) PCT Filed: Nov. 8, 2004

(86) PCT No.: PCT/JP2004/016514

§ 371 (c)(1),
(2), (4) Date: Mar. 22, 2007

(87) PCT Pub. No.: WO2005/050084

PCT Pub. Date: Jun. 2, 2005

(65) Prior Publication Data

US 2007/0268686 A1 Nov. 22, 2007

(30) Foreign Application Priority Data

Nov. 21, 2003 (JP) ..... 2003-391903

(51) Int. Cl.
*F21V 33/001* (2006.01)

(52) U.S. Cl. ..... 362/136; 362/135

(58) Field of Classification Search ..... 362/135–137; 132/288, 289, 291, 315, 316
See application file for complete search history.

(56) References Cited

U.S. PATENT DOCUMENTS 2,494,375 A * 1/1950 Bates et al. ..... 132/288
3,714,411 A * 1/1973 Waters et al. ..... 362/137
4,269,206 A * 5/1981 Boyd ..... 132/288
5,025,354 A * 6/1991 Kondo ..... 362/135
5,832,941 A * 11/1998 Murillo ..... 132/316
6,533,433 B1 * 3/2003 Stark et al. ..... 362/142
6,848,822 B2 * 2/2005 Ballen et al. ..... 362/577
2004/0020509 A1 * 2/2004 Waisman ..... 132/316

FOREIGN PATENT DOCUMENTS

FR 2740859 5/1997

(Continued)

OTHER PUBLICATIONS

Supplementary European Search Report Mailed on May 20, 2008 directed to counterpart application No. EP-04818851; 3 pages.

*Primary Examiner*—Hargobind S Sawhney
(74) *Attorney, Agent, or Firm*—Morrison & Foerster LLP

(57) ABSTRACT

To provide a portable case capable of whatever and wherever radiating various multiple types of light on skin to vary the hue of the skin in making up or wearing an ornament and enabling the variation of the hue of the skin to be viewed in a mirror. A compact in which the mirror for reflecting skin is installed on a cover body for opening and closing a case body including a storage part, comprising a light source part capable of radiating multiple types of light toward the skin to vary the hue of the skin, a battery for powering the light source part, and a selector switch for switching the type of the light emitted from the light source part. The portable case further comprises a slide switch as a light control means for controlling the brightness of the light emitted from the light source part.

2 Claims, 3 Drawing Sheets

FOREIGN PATENT DOCUMENTS

| | | |
|---|---|---|
| FR | 2830315 | 4/2003 |
| JP | 2-34020 | 3/1990 |
| JP | 7-5515 | 1/1995 |
| JP | 7-220522 | 8/1995 |
| JP | 11-102601 | 4/1999 |
| JP | 2002-336106 | 11/2002 |

* cited by examiner

PORTABLE CASE

REFERENCE TO RELATED APPLICATIONS

This application is a national stage application under 35 USC 371 of International Application No. PCT/JP2004/16514, filed Nov. 8, 2004, which claims the priority of Japanese Application No. 2003-391903, filed Nov. 21, 2003, contents of both of which are incorporated herein by reference.

FIELD OF THE INVENTION

The present invention relates to a portable case capable of whenever and wherever radiating various multiple types of light on skin to vary the hue of the skin in making up or wearing an ornament and enabling the variation of the hue of the skin to be viewed in a mirror.

BACKGROUND OF THE INVENTION

As a portable case equipped with a light source, for example, there is known a portable case disclosed in Japanese Patent Application Laid-open Publication No. 11-102601. The object of this "portable case equipped with a light source" is to provide a means with which it becomes possible to view the inside of a bag, a hand when writing something on a memo pad, or a face in a mirror when applying makeup, at a dark place such as an outdoor place at night, in a meeting room where OHP is used, or inside a car at night. This portable case comprises a case body, a cover which is attached so as to be movable to open and close the case body, a light source mounted inside the cover, a mirror attached near the light source. In addition, the portable case has a structure where the mirror is placed below the light source so that an object can be shined up at a dark place, and therefore, a face in a mirror can be viewed at a dark place.

DISCLOSURE OF THE INVENTION

Object of the Invention

Meanwhile, the above-mentioned conventional portable case equipped with a light source, exactly aims to provide lighting, i.e., to simply provide brightness at a dark place. That is, in this portable case, only just shining up an object for a user to see it is taken care of, and providing a means for viewing a face in a mirror to apply makeup is considered the same thing as just shining up an object.

However, when it comes to applying makeup, there is raised another need, that is, makeup finish should be checked in relation to the certain lighting condition. Because a hue of skin applied makeup varies depending on a type of light such as sun light or candle light, and a type of lighting such as indirect lighting or direct lighting, it is desirable to be able to adjust makeup considering the best appearance under the intended light condition.

This need also applies to the case of wearing an ornament such as a pierced earring or another type of earring. For these usages, it is considerably convenient and useful to become able to radiate various multiple types of light on skin to vary the hue of the skin anytime and anywhere in making up or wearing an ornament, enable the variation of the hue of the skin to be viewed in a mirror, and apply makeup or select an ornament according to it; therefore, such a portable case has been desired to be developed.

The present invention has been contrived in consideration of the above-mentioned circumstance. It is an object of the present invention to provide a portable case capable of whenever and wherever radiating various multiple types of light on skin to vary the hue of the skin in making up or wearing an ornament and enabling the variation of the hue of the skin to be viewed in a mirror.

Solution

In accordance with the present invention, a portable case in which a mirror for reflecting skin is installed on a cover body for opening and closing a case body including a storage part, comprises a light source part capable of radiating multiple types of light toward skin to vary the hue of the skin, a battery for powering the light source part, and a selector switch for switching the type of the light emitted from the light source part.

The portable case further comprises a slide switch as a light control means for controlling the brightness of the light emitted from the light source part.

REFERENCE NUMBERS

Figure 1:
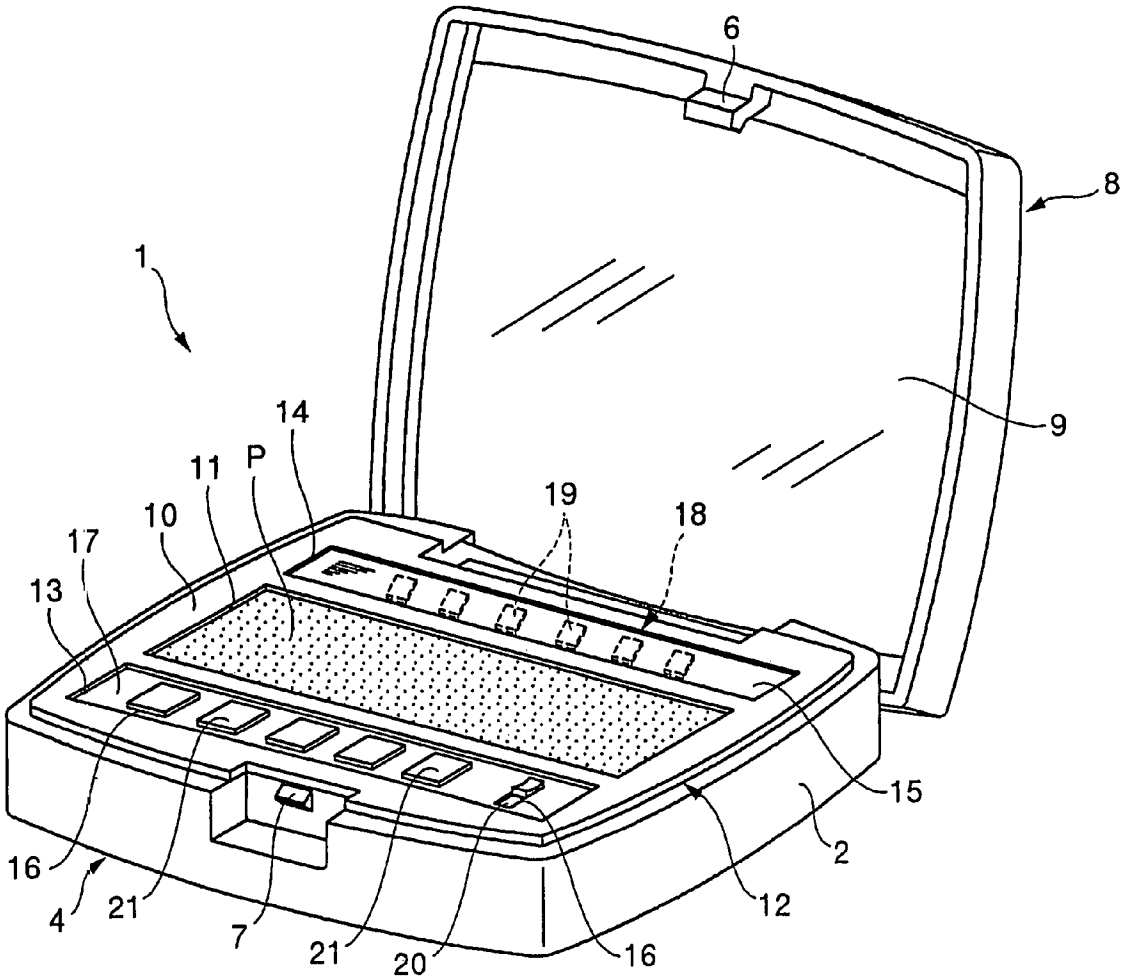
FIG. 1 is a perspective view of a compact with a cover body opened, showing a preferred embodiment of a portable case according to the present invention.

1 compact
4 case body
8 cover body
9 mirror
11 storage part
18 light source part
20 slide switch
24 selector switch
25 battery

DETAILED DESCRIPTION OF A PREFERRED EMBODIMENT

Figure 2:
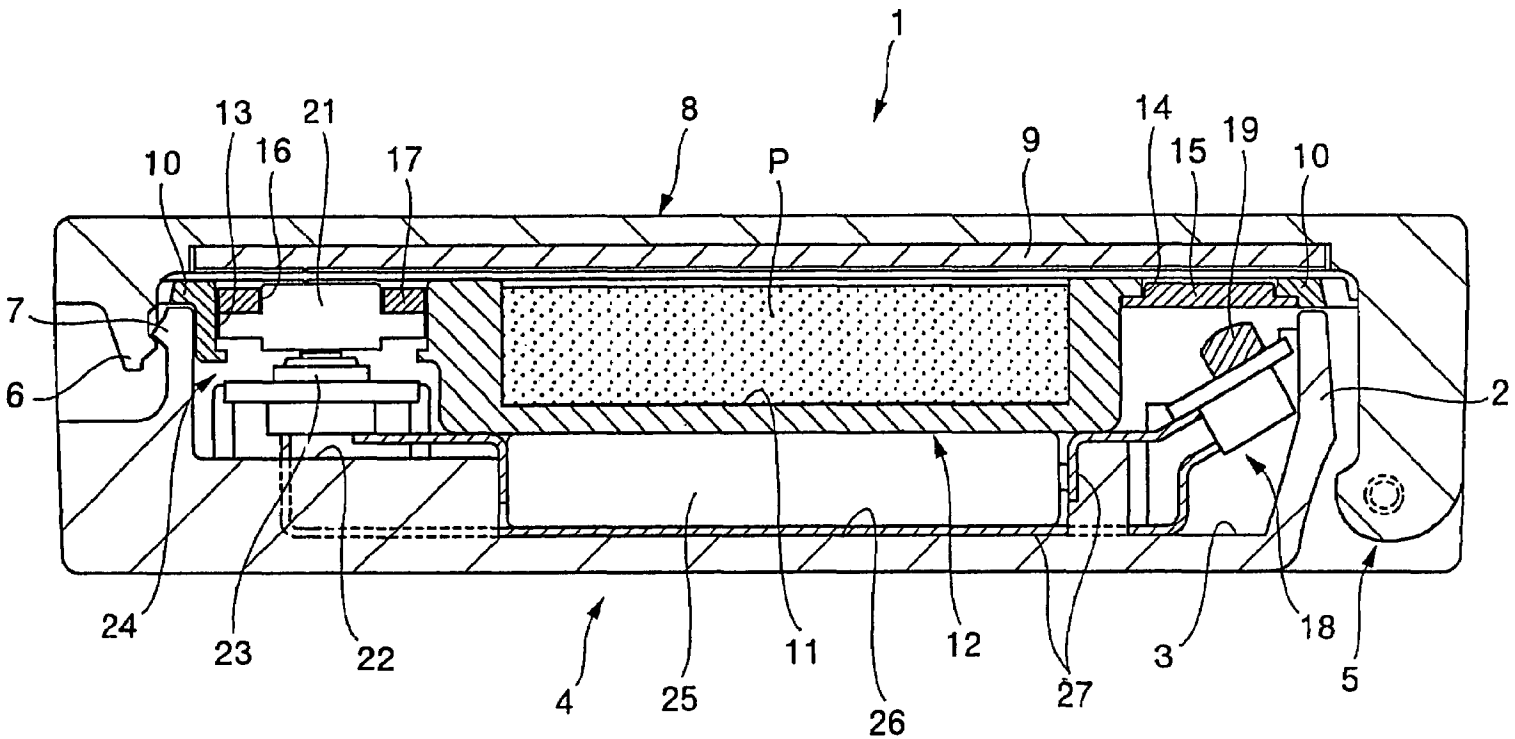
FIG. 2 is a sectional side view of the compact shown in FIG. 1, with the cover body closed.
Figure 3:
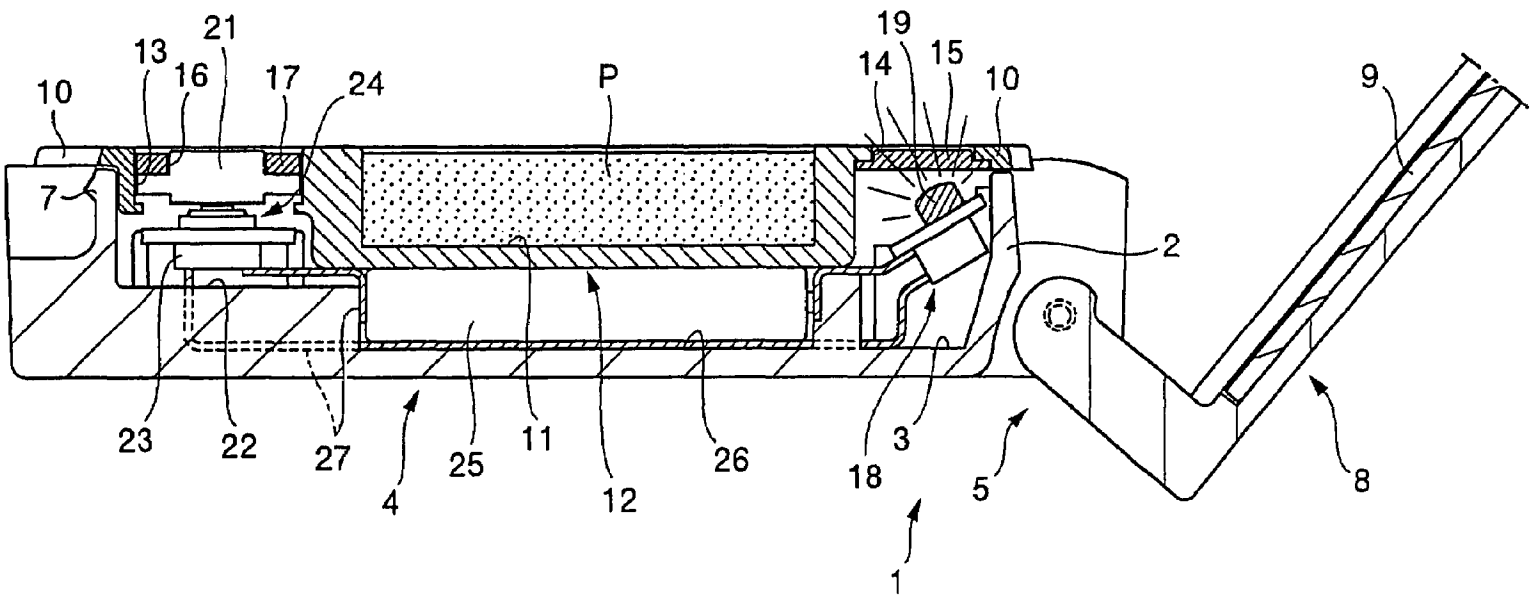
FIG. 3 is a sectional side elevation of the compact shown in FIG. 1.

In the following, a preferred embodiment of a portable case according to the present invention is described in detail with reference to the accompanying drawings. Here it should be noted that, as shown in FIGS. 1 to 3, the embodiment of the present invention is illustrated as a compact 1 for use in containing cosmetic material, but it is also possible to obtain the same effect for a portable case for holding goods put on skin such as an ornament, or another use, besides the compact 1 for cosmetic material.

As shown in the drawings, the compact 1 mainly comprises a portable-size case body 4 within which a concave part 3 is staked and formed with an external wall 2, and a cover body 8 which is rotatably attached at the rear end of the case body 4 with use of a hinge element 5 and has an engaging hook 6 on its front. The engaging hook 6 of the cover body 8 is adapted to be engaged with an engaging projection 7 of the case body 4 to close the case body 4, and to be disengaged from the engaging projection 7 to open the case body 4. On the back side of the cover part 8, a mirror 9 for reflecting skin is attached.

Inside the concave part 3 of the case body 4, a flange member 10 is detachably engaged with the top portion of the external wall 2, and an internal tray 12 including a storage part 11 for storing cosmetic material P is mounted. With the internal tray 12, the storage part 11 is defined in the case body 4. The storage part 11 is placed in the middle of the front-to-back direction of the case body 4, and is formed in the shape of a rectangle with the long side going from left to right.

On the internal tray 12, an opening part 13 penetrating the internal tray 12 in the vertical direction is formed in front of the storage part 11 and along the left-to-right direction of the storage part 11. Also on the internal tray 12, a window part 14 penetrating the internal tray 12 in vertical direction is formed at the back of the storage part 11 and along the left-to-right direction of the storage part 11 so as to be adjacent to the mirror 9. A plate-like translucent cover member 15 is mounted on the window part 14. In addition, a panel member 17 is fitted in the opening part 13, and on the panel member 17, holes 16 are respectively placed at appropriate intervals, along the left-to-right direction of the panel member 17.

Under the cover member 15 of the window part 14, a light source part 18 is mounted so as to be contained within the concave part 3. The light source part 18 comprises a plurality of light-emitting elements 19 including an LED or an organic EL in order to vary a hue of skin. The light-emitting elements 19 are respectively placed at appropriate intervals along the left-to-right direction of the window part 14, or the case body 4. For the light-emitting elements 19, elements respectively emitting a specific light such as sun light, fluorescent light, incandescent light, candle light, shadow light, or another light are used. These light-emitting elements 19 are placed within the concave part 3 near the portion where the cover part 8 is attached, with being inclined forward and upward so as to emit lights in the front and upward direction from the rear portion of the case body 4 through the cover member 15. In this way, they can radiate multiple types of light toward skin to vary a hue of the skin, and enable the variation of the hue of the skin to be viewed in a mirror, when the cover part 8 is opened.

Meanwhile, on the panel member 17 of the opening part 13, a slide switch 20 and a plurality of push buttons 21 are mounted so as to be respectively fitted in the holes 16. Under the push buttons 21, a plurality of push switches 23 are mounted so as to be respectively operated with the push buttons 21, being placed on a shoulder 22 within the concave part 3. The plurality pairs of the push button 21 and the push switch 23 constitutes a selector switch 24 for switching the type of the light emitted from the light source part 18. The slide switch 20 functions as a means for turning .on or off the light source part 18, and also as a light control means for controlling the brightness of the light emitted from the light-emitting element 19 in accordance with the sliding operation of the slide switch 20, due to a variable resistor provided with the slide switch 20. Meanwhile, the function of the selector switch 24 is as follows. Pushing any one of the push buttons 21 turns on the corresponding push switch 23 for the corresponding light-emitting element 19 to emit a light, while pushing the other push button 21 turns off the push switch 23 which have been on until then, and makes the other light-emitting element 19 emit a light.

Inside the concave part 3 of the case body 4, a battery storage part 26 is formed under the storage part 11. In the battery storage part 26, a battery 25 is detachably attached so as to be replaced if needed. The battery 25 for powering the light source part 18, such as a dry battery or a button battery, is successively connected to the selector switch 24 and the light source part 18 through a lead wire 27 wired within the concave part 3, so that with the operations of the slide switch 20 and the push button 21, one of the light-emitting element 19 can emit a light, or the light source part 18 can be turned off.

In the present embodiment comprising the above-mentioned parts and members, the compact 1 functions as follows. For the purpose of applying makeup or another purpose, the engaging hook 6 is disengaged from the engaging projection 7 so that the cover body 8 moves to open the compact 1, and the cover part 8 is held up against the case body 4 in order for skin to be reflected in the mirror 9. Then, the storage part 11 containing cosmetic material P is exposed over the top of the case body 4, as in the case of conventional compacts. In this position, the slide switch 20 is operated, so that the battery 25 starts to supply electricity with the light source part 18, and one of the light-emitting element 19 of the light source part 18 starts to emit a specific light. For changing the light, the corresponding push button 21 should be pushed for the desired push switch 23 to be turned on. Then, the type of the light can be switched. In addition, with the sliding operation of the slide switch 20, the brightness of the light can be controlled.

One of the advantageous features of the present invention is that various types of light such as sun light, fluorescent light, and incandescent light can be emitted from the light-emitting elements 19, and can be switched with use of the selector switch 24. Due to this system, it becomes possible to vary a hue of skin, by radiating toward the skin the light emitted from the light source part 18, which comprises the plurality of light-emitting elements 19 to emit various types of light. Then, it is possible to reflect, in the mirror 9 of the cover part 8, the hue, of the skin and the look on the face under the specific light condition which can be recreated with the light emitted from the corresponding light-emitting element 19.

In this way, with use of the compact 1 of the present embodiment, it becomes possible to apply makeup in considering the hue of skin which varies depending on a light type or a lighting. Especially, because the compact 1 has the battery 25 installed and is portable, it is possible to whenever and wherever radiate various multiple types of light on skin, and check the hue of the skin to adjust makeup. That is considerably convenient and useful.

Meanwhile, in the above description, the embodiment of the present invention is illustrated as the compact 1 for use in containing cosmetic material, but it is also possible to obtain the same effect for a portable case for holding goods put on skin such as an ornament, or another use.

INDUSTRIAL APPLICABILITY

With use of a portable case according to the present invention, it is possible to whenever and wherever radiate various multiple types of light on skin to vary the hue of the skin in making up or wearing an ornament and enabling the variation of the hue of the skin to be viewed in a mirror.

The invention claimed is:

1. A portable case in which a mirror for reflecting light from skin is installed in a cover body for opening and closing a case body including a storage part, comprising:

a light source part having plural types of light-emitting elements placed in said case body in order to vary the hue of light directed toward skin of a user of the portable case;

a battery for powering the light source part; and selector switches for selectively switching the type of the light emitted from the light-emitting elements, wherein said light-emitting elements are placed within a concave part near a portion where said cover body is attached and are mounted on an area inclined forward and upward so as to emit lights in the front and upward direction of said case body from a rear portion of said case body.

2. A portable case according to claim 1, further comprising:

a light control means for controlling the brightness of the light emitted from the light source part.

* * * * *